US009586086B2

(12) United States Patent
Dalebout et al.

(10) Patent No.: US 9,586,086 B2
(45) Date of Patent: Mar. 7, 2017

(54) ELLIPTICAL EXERCISE MACHINE WITH AN ADJUSTABLE CONNECTION

(71) Applicant: ICON Health & Fitness, Inc., Logan, UT (US)

(72) Inventors: William T. Dalebout, North Logan, UT (US); Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/751,483

(22) Filed: Jun. 26, 2015

(65) Prior Publication Data

US 2016/0001122 A1 Jan. 7, 2016

Related U.S. Application Data

(60) Provisional application No. 62/020,312, filed on Jul. 2, 2014.

(51) Int. Cl.

| | |
|---|---|
| ***A63B 22/00*** | (2006.01) |
| ***A63B 22/04*** | (2006.01) |
| ***A63B 71/00*** | (2006.01) |
| ***A63B 22/06*** | (2006.01) |
| *A63B 21/00* | (2006.01) |

(Continued)

(52) U.S. Cl.

CPC ..... *A63B 22/0015* (2013.01); *A63B 22/001* (2013.01); *A63B 22/0664* (2013.01); *A63B 21/0051* (2013.01); *A63B 21/00076* (2013.01); *A63B 21/225* (2013.01); *A63B 2022/067* (2013.01)

(58) Field of Classification Search

CPC ..... A63B 22/00; A63B 22/06; A63B 22/0664; A63B 22/12; A63B 22/14; A63B 22/001; A63B 22/0015; A63B 23/04; A63B 23/0405; A63B 23/0417; A63B 23/0423; A63B 23/0429; A63B 23/0452; A63B 23/0447; A63B 23/0441; A63B 23/035

USPC ..... 482/51, 52, 70, 71

See application file for complete search history.

(56) References Cited

U.S. PATENT DOCUMENTS 6,027,431 A * 2/2000 Stearns ..... A63B 21/068 482/51
6,939,271 B1 * 9/2005 Whan-Tong ..... A63B 22/001 482/52

(Continued)

FOREIGN PATENT DOCUMENTS

| | | |
|---|---|---|
| EP | 2431077 | 5/2014 |
| JP | 3114683 | 10/2005 |
| WO | 2008/114291 | 9/2008 |

OTHER PUBLICATIONS

International Search Report issued for PCT/US2015/038642 on Sep. 10, 2015.

(Continued)

*Primary Examiner* — Garrett Atkinson
(74) *Attorney, Agent, or Firm* — Holland & Hart LLP

(57) ABSTRACT

An elliptical exercise machine includes a crank member with a first portion connected to a resistance mechanism and a second portion comprising an adjustable connection arranged to attach to a foot support. The adjustable connection is arranged to change a connection point between crank member and the foot support along a length of the crank member.

16 Claims, 5 Drawing Sheets

(51) Int. Cl.
*A63B 21/005* (2006.01)
*A63B 21/22* (2006.01)

(56) References Cited

U.S. PATENT DOCUMENTS

| | | | | |
|---|---|---|---|---|
| 7,097,591 | B2 * | 8/2006 | Moon | A63B 22/001 482/52 |
| 7,462,134 | B2 * | 12/2008 | Lull | A63B 22/0015 482/52 |
| 7,604,573 | B2 * | 10/2009 | Dalebout | A63B 22/001 482/52 |
| 7,704,192 | B2 * | 4/2010 | Dyer | A63B 22/001 482/52 |
| 7,901,330 | B2 * | 3/2011 | Dalebout | A63B 22/001 482/52 |
| 2006/0166791 | A1 * | 7/2006 | Liao | A63B 22/001 482/52 |
| 2008/0114291 | A1 * | 5/2008 | Muri | A61M 1/0058 604/35 |
| 2010/0263476 | A1 * | 10/2010 | Peschmann | G05G 1/085 74/546 |

OTHER PUBLICATIONS

English translation of the abstract of JP 3114683. Oct. 27, 2005.

* cited by examiner

ELLIPTICAL EXERCISE MACHINE WITH AN ADJUSTABLE CONNECTION

RELATED APPLICATIONS

This application claims priority to provisional Patent Application No. 62/020,312 filed Jul. 2, 2014, which application is hereby incorporated by reference for all that it discloses.

BACKGROUND

The following relates generally to exercise machines, and particularly relates to the field of mechanisms, systems, and methods for controlling the stride of footholds of an elliptical exercise machine.

Ellipticals are a type of exercise machine that include foot supports configured to travel about a reciprocating paths to simulate striding, running, walking, or climbing motions. In general, an elliptical or elliptical-type exercise machine comprises a pair of reciprocating foot supports constructed to receive and support the feet of a user. Each reciprocating foot support has at least one end supported for rotational motion about a pivot point (e.g., at a pivot end or pivot connection), with the other end supported in a manner arranged to cause the reciprocating foot support to travel about a closed path. Upon operation of the exercise machine, each reciprocating foot support is caused to travel along the closed path, thereby simulating a striding motion of the user. Often, the reciprocating foot supports are configured to be out of phase with one another by approximately 180 degrees in order to simulate a natural alternating stride motion.

An individual may use an elliptical exercise machine by placing his or her feet onto the reciprocating foot supports. Once standing on the foot supports, the individual may actuate the exercise machine for any desired length of time and at any desired pace to cause the reciprocating foot supports to repeatedly travel their respective closed paths, which action effectively results in a series of strides achieved by the individual to obtain a desired level of exercise. Exercise achieved using an elliptical exercise machine is particularly favored by individuals seeking aerobic exercise that causes little or no physical impact to their frame and joints.

An example of an elliptical exercise machine is disclosed in U.S. Pat. No. 7,901,330, which was issued to William Dalebout. This references describes an exercise machine, and particularly a front or rear mount elliptical or elliptical-type machine, comprising: a support structure, a drive component pivotally coupled to the support structure and configured to rotate about a first pivot axis; a reciprocating foot support configured to travel about a closed path having a stride length upon rotation of the drive component; a coupling configuration configured to support the reciprocating foot support about the drive component at a position radially offset from the first pivot axis where the coupling configuration pivotally coupled to the drive component about a second pivot axis; and an adjustment mechanism configured to enable the coupling configuration to pivot about the second pivot axis between at least two adjustment positions to vary the radial offset of the reciprocating foot support with respect to the first pivot axis. Other examples of elliptical exercise machines are described in European Patent Publication No. EP2431077 issue to Eric Hsu and U.S. Pat. No. 7,097,591 issued to Daniel Ross Moon and U.S. Pat. No. 7,462,134, issued to Andrew P. Lull, et al.

SUMMARY

In one aspect of the invention, an elliptical exercise machine comprises a crank member with a first portion connected to a resistance mechanism and a second portion comprising an adjustable connection arranged to attach to a foot support.

In one aspect of the invention, the adjustable connection is arranged to change a connection point between crank member and the foot support along a length of the crank member.

In one aspect of the invention, changing the connection point changes a stride length of the elliptical exercise machine.

In one aspect of the invention, the adjustable connection comprises a threaded rod aligned with the length of the crank member and the foot support is shaped to connect to the threaded rod.

In one aspect of the invention, the first selector is integrated into the first dumbbell and the second selector is integrated into the second dumbbell.

In one aspect of the invention, the elliptical exercise machine comprises a handle connected to the threaded rod, wherein movement of the handle rotates the threaded rod.

In one aspect of the invention, the handle is positioned proximate a distal end of the crank arm.

In one aspect of the invention, the elliptical exercise machine comprises a motor positioned to rotate the threaded rod.

In one aspect of the invention, the resistance mechanism comprises a flywheel.

In one aspect of the invention, the elliptical exercise machine comprises a slot formed in the crank member, and the foot support is connected to the adjustable connection through the slot.

In one aspect of the invention, the slot comprises a first closed end and a second closed end that define a translation range of the adjustable connection.

In one aspect of the invention, the elliptical exercise machine comprises stride indicators positioned proximate the slot.

In one aspect of the invention, the adjustable connection is a pivot connection.

In one aspect of the invention, the adjustable connection comprises a pivot stem arranged transverse a treaded rod.

In one aspect of the invention, an elliptical exercise machine comprises a crank member with a first portion connected to a resistance mechanism and a second portion comprising an adjustable connection arranged to attach to a foot support.

In one aspect of the invention, the adjustable connection is arranged to change a connection point between crank member and the foot support along a length of the crank member.

In one aspect of the invention, the adjustable connection comprises a threaded rod aligned with the length of the crank member and the foot support is shaped to connect to the threaded rod.

In one aspect of the invention, changing the connection point changes a stride length of the elliptical exercise machine.

In one aspect of the invention, the elliptical exercise machine comprises a slot formed in the crank member, and the foot support is connected to the adjustable connection through the slot.

In one aspect of the invention, the slot comprises a first closed end and a second closed end that define a translation range of the adjustable connection.

In one aspect of the invention, the elliptical exercise machine comprises stride indicators positioned proximate the slot.

In one aspect of the invention, the adjustable connection is a pivot connection.

In one aspect of the invention, the adjustable connection comprises a pivot stem arranged transverse a treaded rod.

In one aspect of the invention, the elliptical exercise machine comprises a motor positioned to rotate the threaded rod.

In one aspect of the invention, an elliptical exercise machine comprises a crank member with a first portion connected to a resistance mechanism and a second portion comprising an adjustable connection arranged to attach to a foot support.

In one aspect of the invention, the adjustable connection being arranged to change a connection point between crank member and the foot support along a length of the crank member.

In one aspect of the invention, the adjustable connection comprises a threaded rod aligned with the length of the crank member and the foot support is shaped to connect to the threaded rod.

In one aspect of the invention, a slot is formed in the crank member and the foot support is connected to the adjustable connection through the slot.

In one aspect of the invention, the slot comprises a first closed end and a second closed end that define a translation range of the adjustable connection.

In one aspect of the invention, the adjustable connection is a pivot connection with a pivot stem arranged transverse a treaded rod.

In one aspect of the invention, changing the connection point changes a stride length of the elliptical exercise machine.

Any of the aspects of the invention detailed above may be combined with any other aspect of the invention detailed herein.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
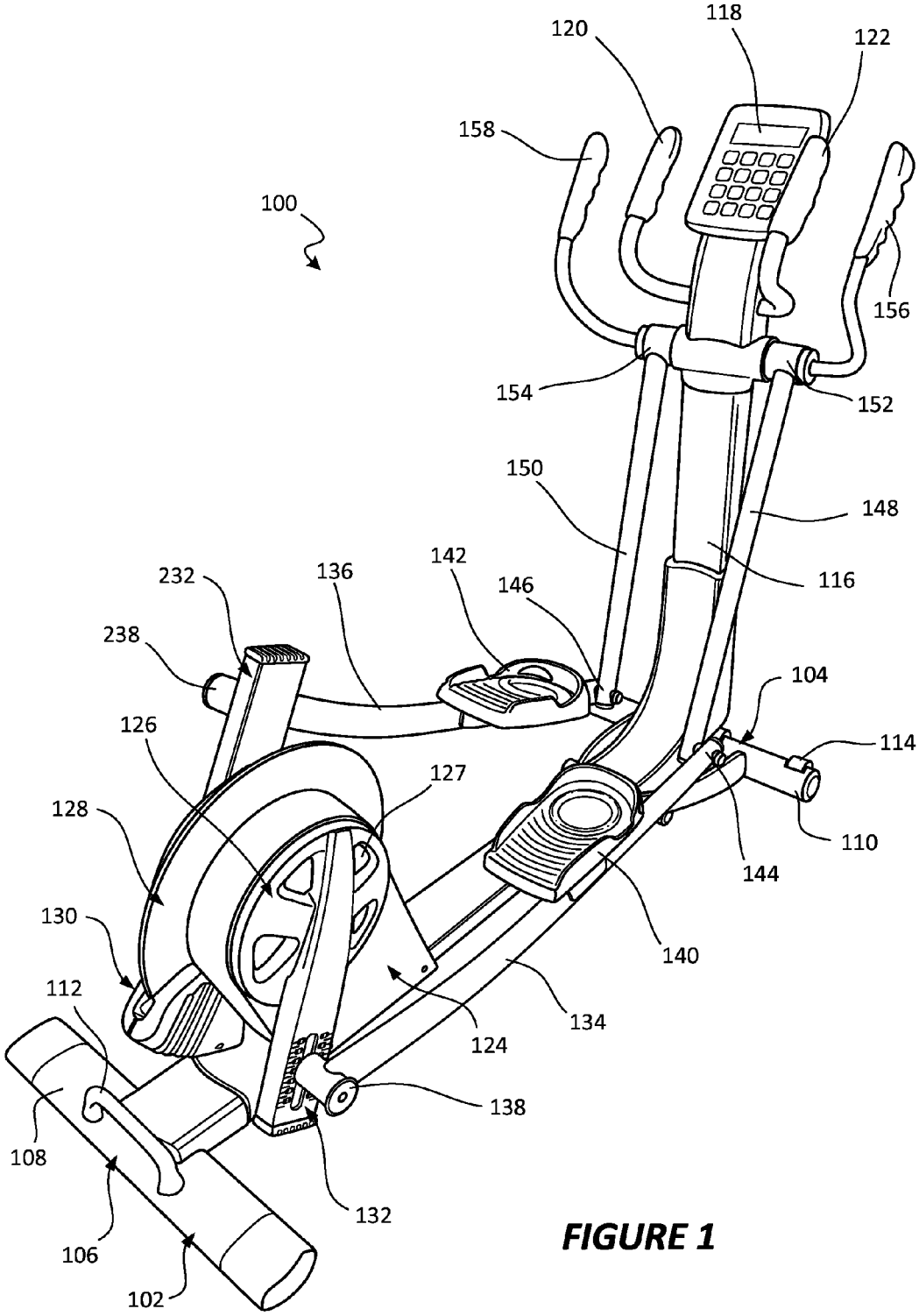
FIG. 1 is a perspective view of an example of an elliptical exercise machine having adjustable stride radius according to an embodiment of the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

An elliptical exercise machine may include an adjustable rotation assembly and stride mechanism system as disclosed herein. Specifically, the present system provides an elliptical exercise machine having an adjustable radius of rotation for connecting a reciprocating foot support with a crank member of a drive unit. The adjustable connections may be arranged to allow a user to quickly select and dynamically achieve an infinite number of possible radii of rotation within a defined range without requiring overly complex, expensive, and potentially dangerous swinging linkages. The adjustable connections may simultaneously adjust an overall width and height dimension of the striding motion of the reciprocating foot supports while keeping the footholds fixed in place relative to their supporting beams. Some embodiments of the present system may be self-contained, involve low maintenance, and have no removable parts prone to being lost or stolen.

According to one embodiment, an elliptical exercise machine has a drive unit having a connection point between at least one support bar of a reciprocating foot support and a crank member of the drive unit. For example, the drive unit may have a crank member extending radially from a center of rotation of the drive unit. An adjustable connection may include a threaded attachment between a threaded rod in the crank member and the foot support. In some cases, the threaded rod is aligned with a length of the crank member. A handle or lever may be attached to a portion of the threaded rod to allow the user to rotate the threaded rod. As the threaded rod rotates, the connection point between the crank member and the foot support changes depending on the direction that the threaded rod is rotated.

In some arrangements, two crank members may be attached to the drive unit at approximately 180 degrees out of phase to provide alternating reciprocation for each of the foot supports. Each of the crank members may have separate stride radius controls provided by separate threaded rods housed in each of the crank members. As the connection points change between the crank members and the foot supports, the user's stride also changes. To keep the radius of stride substantially the same, stride length indicators may be provided along the length of the threaded rod so that the position of the connection point may be compared and coordinated according to the desires of the user.

In some configurations, the range of adjustment of the pivot connection may be limited by the length of the threaded rod. In other configurations, the range is bounded by the dimensions of a slot in the crank member through which the foot support is connected to the threaded rod. For example, a slot may be formed in the crank member with the threaded rod aligned with a length of the crank member. When the foot support is in threaded connection with the threaded rod (e.g., via a stem assembly), the connection point may translate along the length of the rod.

In some embodiments, the threaded connection may be linked to a motor that is positioned to rotate the threaded rod. As the motor rotates the threaded rod, the threaded rod's threadform causes the connection point to translate along its length. By controlling the motor, the user may selectively cause the threaded rod to rotate around its longitudinal axis and thereby reposition the connection point. In some examples, the motor is operable while a user is exercising with the elliptical. In such an example, the user may control the motor, and therefore the stride length, while the elliptical exercise machine is being operated.

For purposes of this disclosure, the term "aligned" means parallel, substantially parallel, or forming an angle of less than 35 degrees. For purposes of this disclosure, the term "transverse" means perpendicular, substantially perpendicular, or forming an angle between 55 and 125 degrees. For purposes of this disclosure, the term "length" refers to the longest dimension of the described object.

Now with reference to the figures in particular, FIG. 1 shows a perspective view of an elliptical exercise machine 100 with adjustable stride radius according to an embodiment of the present disclosure. The elliptical exercise machine 100 may comprise a base support structure 102 which may provide support for the elliptical exercise machine 100 on a support surface, such as, for example, a floor. The base support structure 102 may have a front end 104 and a rear end 106. Each end 104, 106 may have stabilizers 108, 110 keeping the elliptical exercise machine 100 upright while in use. The rear end 106 may include a handle 112 to allow repositioning the elliptical exercise machine 100. For example, the handle 112 may be used to lift the rear end 106 of the base support 102 and reposition the elliptical exercise machine 100 using rollers 114 on the front stabilizer 110 of the base support 102.

The front end 104 of the base support structure 102 may include an upright support structure 116 extending upward. For example, the upright support structure 116 may extend substantially perpendicular from the front end 104 of the base support structure 102 and the support surface. The upright support structure 116 may include a console 118 and a pair of stationary handles 120, 122.

The base support structure 102 and upright support structure 116 may comprise a rigid, heavy material. For example, these structures may comprise steel, aluminum, or another tough metal providing weight and stability to the support structure. In some embodiments these support structures may comprise a composite or plastic material protecting a metal base frame.

The rear end 106 of the elliptical exercise machine 100 may also include a drive unit 124. The drive unit 124 may include a rotation base 126, 226 on each of its opposing sides, and a flywheel 128 disposed between the rotation bases 126, 226. The flywheel 128 may be part of a resistance assembly 130 that is contained by the drive unit 124 between the rotation bases 126, 226. For example, the resistance assembly 130 may comprise a magnetic resistance system such as, for example, a silent magnetic resistance unit providing resistance to the rotation of the rotation bases 126, 226 of the drive unit 124. In some embodiments, alternative resistance assemblies may be installed, such as, for example, an eddy current braking (ECB) system or a magnetic motorized brake system.

A crank member 132, 232 may extend radially from the drive unit 124. For example, a crank member 132, 232 may be formed as part of the exterior of, and extend radially from, a rotation base 126, 226. Thus, the elliptical exercise machine 100 may include two crank members 132, 232, each being linked to a rotation base 126, 226 on each side of the drive unit 124. In some embodiments, it may be beneficial for the crank members 132, 232 to be formed to extend outward from the center of rotation 233 of the rotation base 126, 226. Each crank member 132, 232 may be pivotally linked to the reciprocating foot supports 134, 136 by a pivot connection 138, 238 at the rear end of the reciprocating foot supports 134, 136. Thus, the crank member 132, 232 and pivot connection 138, 238 may provide repetitive rotational motion to reciprocating foot supports 134, 136 as the pivot connections 138, 238 rotate around the rotation base 126, 226.

The crank members 132, 232 and rotation bases 126, 226 may be comprised of a strong, durable material including, for example, steel or aluminum. The crank members 132, 232 and rotation bases 126, 226 may include outer housings over a strong metal internal frame or substructure, and the outer housings may comprise plastics, composites, or other lighter, more colorful, or more easily shaped materials to reduce cost and weight or to add aesthetic value and style. For example, in the embodiment shown in FIG. 1, the rotation base 126 includes vents 127 which reduce weight and manufacturing costs of the rotation base while improving aesthetics of the elliptical exercise machine 100.

The reciprocating foot supports 134, 136 may include footholds 140, 142 positioned to receive a user's feet while operating the elliptical exercise machine 100. The footholds 140, 142 may be positioned forward from the drive unit 124 and to the rear of the upright support structure 116. The reciprocating foot supports 134, 136 may have pivoting front ends 144, 146 pivotally linked to upright swing linkages 148, 150 which have pivotally linked upper ends 152, 154 connected to the upright support structure 116. The upright swing linkages 148, 150 may also have rotatable handles 156, 158 extending from the pivotally linked upper ends 152, 154 to provide a moving handhold for a user on the footholds 140, 142 and simulating cross-country skiing movement when the reciprocating foot supports 134, 136 are in motion.

Figure 2:
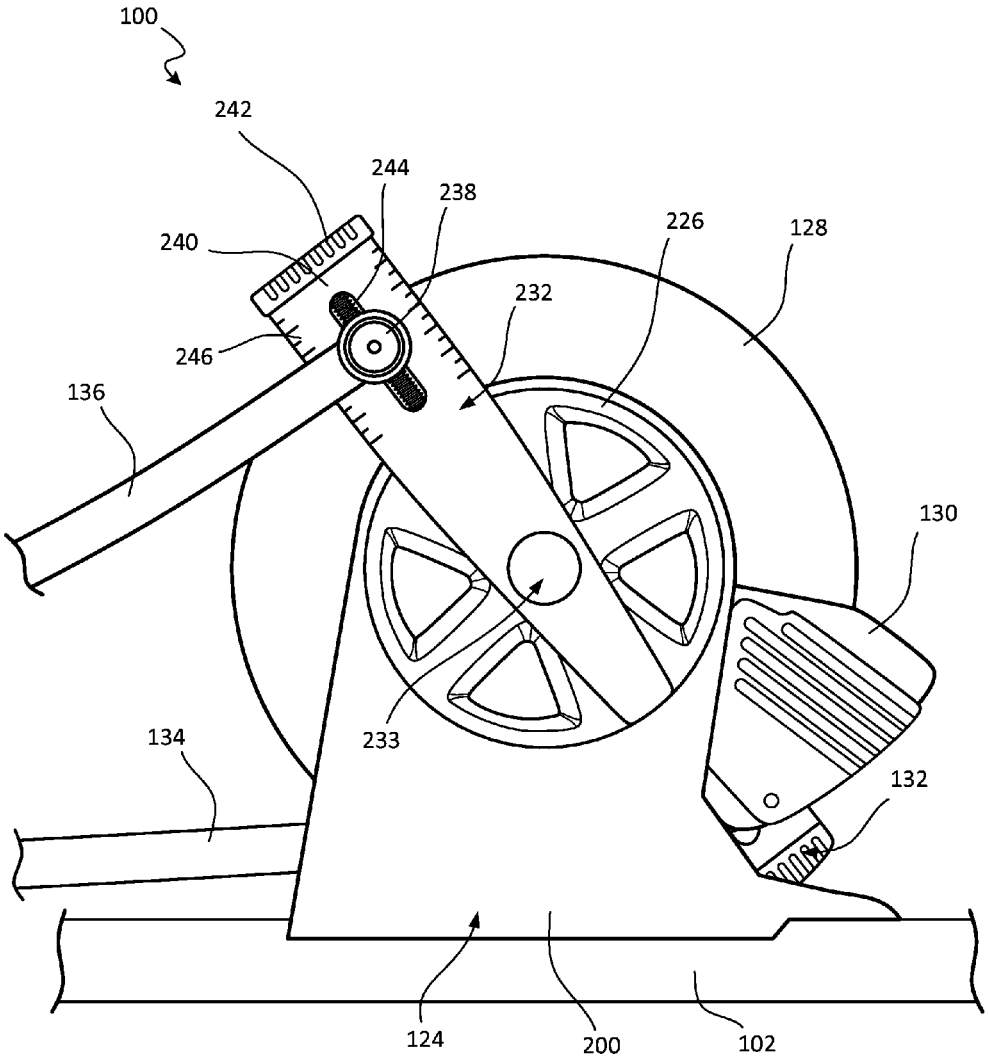
FIG. 2 is a side view of an example of a drive unit portion of an elliptical exercise machine having adjustable stride radius according to an embodiment of the present disclosure.

Additional detail regarding the drive unit 124 and associated elements is provided in FIG. 2. The drive unit 124 may include a rotation base 226 mounted on a drive unit frame 200 linked to the base support structure 102. The rotation base 226 may drive a flywheel 128 within a resistance assembly 130, as described above. The rotation bases 126, 226 may be vented (e.g., vent 127) to reduce weight and for improved aesthetics. The rotation bases 126, 226 may be rotatable within respective substantially vertical, substantially aligned planes of rotation. The rotation bases 126, 226 may rotate around a center of rotation 233. For example, the center of rotation 233 may be an axis around which the rotation bases 126, 226 rotate while the elliptical exercise machine 100 is operated. The axis may be the axis of rotation of the flywheel 128, or associated with the geometry of the rotation bases 126, 226. In some embodiments, the rotation bases 126, 226 may have non-parallel planes of rotation, such as, for example, an upward or downward V-shaped relationship between the planes of rotation of the rotation bases 126, 226, thereby providing inward and outward motion of the footholds 140, 142 while they are in motion.

A crank member 232 is shown extending radially outward from the rotation base 226. In some embodiments, the crank member 232 may beneficially extend outward from the center of rotation 233, thereby efficiently providing rotation around the center of rotation 233 at the pivot connection 238. The rear side of the other crank member 132 is also shown, illustrating the 180-degree out-of-phase arrangement of the crank members 132, 232. The outer end 240 of crank member 232 bears the pivot connection 238 linked to reciprocating foot support 136. In some embodiments, the crank member 232 and the rotation base 226 are attached to each other, providing an integrated base-arm relationship. In some embodiments, no crank member 232 extends from the rotation base 226, and the pivot connection 238 is connected adjacent to the rotation base 226. Embodiments with a crank member 232 may provide a greater degree of adjustability to the reciprocating foot support 136 by allowing a greater distance of travel for the pivot connection 238 from the center of rotation 233. Embodiments with no crank member 232 may be more compact, use less materials in construction, and/or may provide a smaller amount of adjustability of the pivot connection 238.

The outer end 240 of the crank member 232 includes a rotatable handle 242. The handle 242 may be turned relative to the outer end 240, thereby rotating a threaded rod 244 housed within the outer end 240. For example, the handle 242 may be rotated along an axis aligned with the longitudinal axis of the threaded rod 244. In some arrangements, the handle 242 may be textured to provide grip to the hand of a user. The handle 242 may be interconnected with the outer end 240 of the crank member 232, thus preventing the handle 242 from being disconnected from the crank member 232 while the elliptical exercise machine 100 is operated or while the handle 242 is rotated. In some arrangements, the handle 242 may be interconnected with the interior of the crank member 232 via the threaded rod 244. In some arrangements, the handle 242 may be attached to the rotation base 226. For example, the handle 242 may have an axis of rotation aligned with the horizontal axis of rotation of the flywheel 128, and the handle 242 may then be connected to the threaded rod 244 in the rotation base 226 to provide adjustment when there is no crank member 232. The outer end 240 of the crank member 232 may also bear stride length indicators 246 to assist the user in selecting a radius of rotation of the pivot connection 238 while rotating the handle 242.

The rotatable handle 242 may beneficially comprise a plastic, wood, or metal material. A plastic material may be used to reduce weight and cost of elements related to the crank member 232 while providing durability and a plurality of colors and shapes for aesthetic reasons. The threaded rod 244 is preferably a strong metal, such as, for example, steel, with high durability and wear resistance to allow the threaded rod 244 to hold the weight of the reciprocating foot supports 134, 136 on its threads without shearing, bending, or locking up, even while a user operates the machine. The material for the threaded rod 244 may also beneficially be resistant to grease and other lubricants that may be applied to the threaded rod 244 to ease adjustment of the pivot connection 238 when the handle 242 is used.

Figure 3:
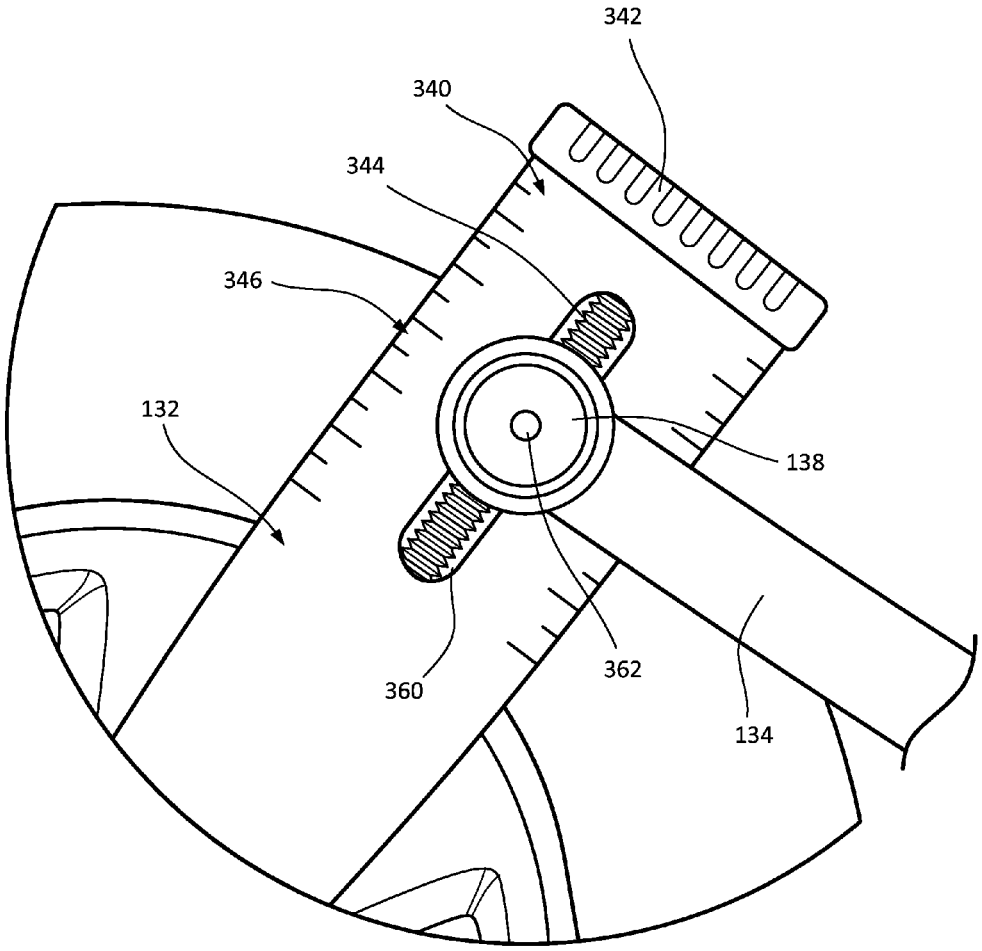
FIG. 3 is a side view of an example of end of a crank member of an elliptical exercise machine having adjustable stride radius according to an embodiment of the present disclosure.

FIG. 3 is a close-up side view of a crank member 132 showing detail of its outer end 340. The pivot connection 138 is substantially centrally positioned in a slot 360 extending radially along the length of the crank member 232. The reciprocating foot support 134 extends forward from the pivot connection 138. The slot 360 provides a partial view of the threaded rod 344 extending along the length of the crank member 132. The pivot connection 138 pivots around a stem assembly 362. The stem assembly 362 may be in threaded connection with the internal threaded rod 344 and extend through the slot 360 away from the outer end 340 of the crank member 132. In some arrangements, the stem assembly 362 may not be viewable from the exterior of the elliptical exercise machine 100. For example, the stem assembly 362 may be covered by an end cap on the outer area of the pivoting connection 138. In some configurations, the stem assembly 362 may be inserted into a recess or hole in the pivoting connection 138 and the stem assembly 362 may therefore be internal to the pivoting connection 138 and not viewable from the exterior of the elliptical exercise machine 100. The stem assembly 362 may beneficially include a straight, cylindrical portion extending from the outer end 340 of the crank member 132 that is sized and shaped to securely retain the pivoting connection 138. In some embodiments, the pivoting connection 138 may be removably attached to the stem assembly 362. Such a configuration may beneficially allow easier maintenance and replacement of parts at the outer end 340 or other portions of the elliptical exercise machine 100.

In some embodiments, the threaded rod 344 may be accessible from the exterior of the crank member 132 or may extend outward from the outer end 340 of the crank member 132. In such embodiments, support bars or additional threaded rods 344 may be implemented to stabilize and/or reinforce the threaded rod 344 when it is under a load passing through the stem assembly 362.

In some embodiments, the slot 360 may not be parallel to the length of the crank member 132. For example, the slot 360 may be curved along the crank member 132 and therefore may allow the pivot connection 138 and stem assembly 362 to have a variable rate of change of stride radius in relation to the center of rotation of the crank member 132. In such an embodiment, the distance between the center of rotation and the pivot connection 138 may increase quickly as the stem assembly 362 traverses a portion of the curved slot that is aligned to the crank member 132, but gradually change at a slower rate as the distance between the pivot connection 138 and the center of rotation increases. In such embodiments, the threaded rod 344 may be curved to follow the shape of the slot or may extend radially from the center of rotation with just a portion of the threaded rod 344 visible through the slot. In other embodiments, the crank member 132 may be curved or take another shape relative to the rotation base 126.

Stride indicators 346 may be positioned proximate each side of the slot 360. For example, the stride indicators 346 may be temporarily or permanently affixed to the outer end 340 adjacent to the slot 360. In some arrangements, the stride indicators 346 may be inscribed, engraved, printed, pad printed/tamped, stamped, dye sublimated, painted, etched, and/or attached to the outer end 340 by way of a separate medium, such as an adhesive sticker, label, fastened plate, or another feature serving a similar marking function. The stride indicators 346 may also be molded or otherwise formed as a part of the outer end 340 or slot 360. For example, the slot 360 may be cut from the outer end 340 of the pivot connection 138, and the stride indicators 346 may be cut into the sides of the slot 360 to provide permanent markings adjacent to the main opening of the slot 360. The stride indicators 346 may indicate a measurement of distance (e.g., a number of inches, meters, or partitions thereof) or may indicate an arbitrary or relative span of length, such as, for example, a number of "units" or "notches" away from the rotation base, or a number of "turns" of the handle 342.

In some embodiments, the stride indicators 346 are positioned on both sides of the slot 360 to improve readability of the stride indicators 346 when one side is partially obscured by the reciprocating foot supports 134, 136. In other embodiments, the stride indicators 246, 346 may be positioned on just one side of the slot 360. Stride indicators 246, 346 may be identical or at least comparable on each crank member 132, 232, thereby allowing the user to select an identical position for each pivot connection 138, 238.

The handle 342 may be attached to the peripheral end of the threaded rod 344 at a peripheral portion of the outer end 340 of the crank member 132. The handle 342 may provide leverage for a user to apply a torque to the threaded rod 344 when repositioning the pivot connection 138. The handle 342 may be shaped, contoured, or textured to provide grip and tactility to a user's hand. In some embodiments, the handle 342 may be directly attached to the threaded rod 344, meaning an end of the threaded rod 344 is directly, physically attached to the handle 342 (e.g., via glue, interlocking parts, an interference fit, a fastener, or a similar connecting mechanism) or is integrally formed with a portion of the handle 342 (e.g., via a casting, a welding, sintering, or similar fusing mechanism). In other embodiments, the handle 342 may be indirectly attached to the threaded rod 344 such that the end of the threaded rod 344 is connected to a portion of the handle via a linkage. Such a linkage may be a gear system or displacement rod.

Figure 4:
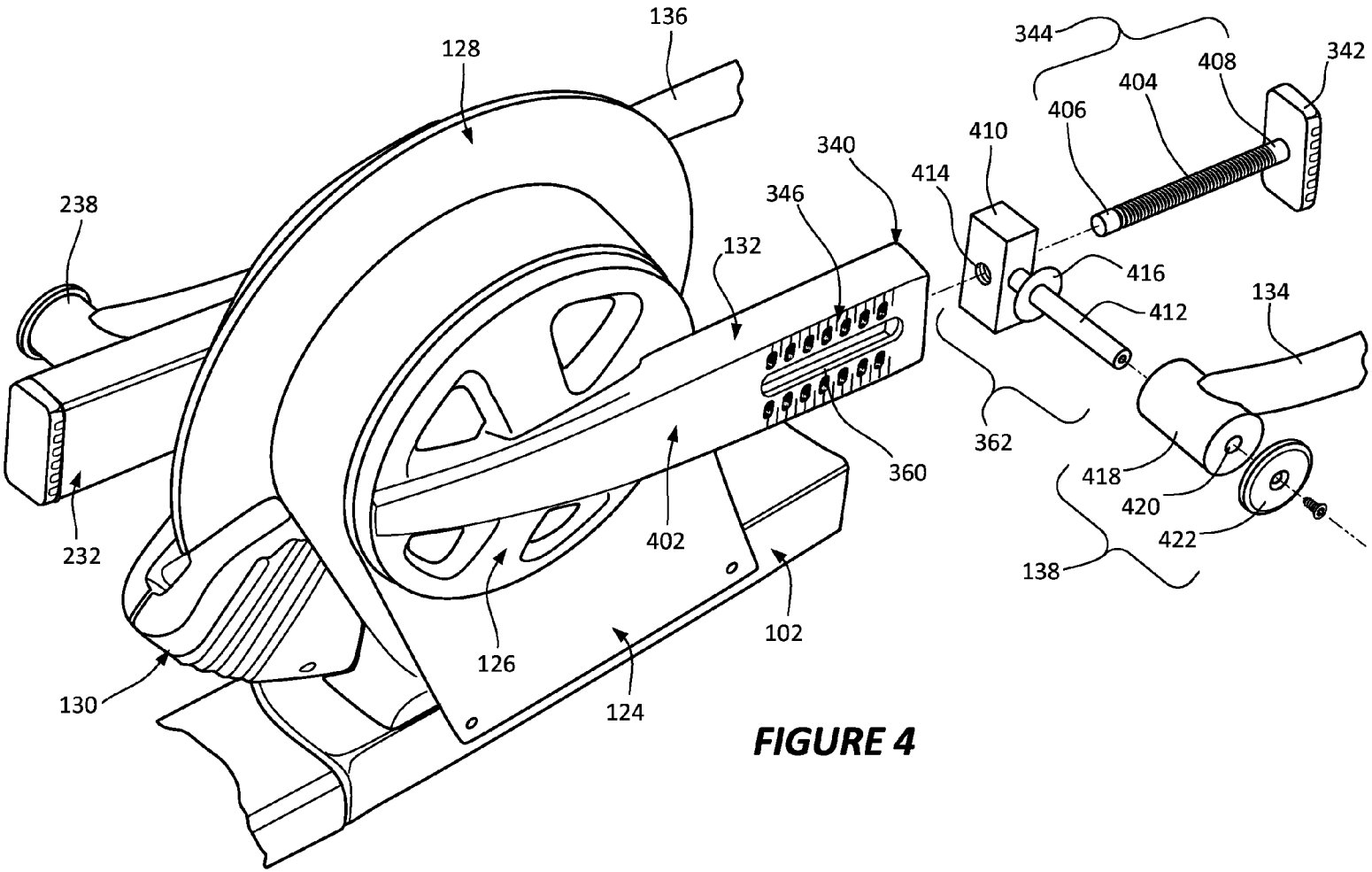
FIG. 4 is an exploded view of an example of a crank member of an elliptical exercise machine having adjustable stride radius according to an embodiment of the present disclosure.

FIG. 4 shows an exploded perspective view of the outer end of a crank member 132. The crank member 132 has a longitudinal slot 360 with stride indicators 346 on the surface of the outer end 340 on each side of the slot 360. The threaded rod 344 fits within the outer end 340 and may be attached to an internal surface of the crank member 132, such as at an internal feature of the inner end 402 of the crank member. Alternatively, the threaded rod 344 may be attached to the outer end 340 of the crank member 132 at the periphery near the handle 342.

In some embodiments, the threaded rod 344 may comprise a threaded portion 404 and one or more attachment portions 406, 408 along its length. The threaded portion 404 may be the portion of the threaded rod 344 in threaded connection with the stem assembly 362. As such, the threaded portion 404 may beneficially have a length sufficient to substantially span the length of the slot 360 to allow the stem assembly 362 to move throughout the length of the slot 360 when the threaded rod 344 is rotated. The attachment portions 406, 408 may be portions of the threaded rod 344 having features for attachment to the crank member 132. For example, the attachment portions 406, 408 may include ridges for interlocking with internal surfaces of the outer end 340 or inner end 402 and preventing the threaded rod 344 from making unwanted longitudinal movements in relation to the crank member 132. In some embodiments, just one attachment portion 406, 408 may be provided. In yet other embodiments, the threaded rod 344 may not have designated attachment portions 406, 408, and the threaded rod 344 may be indirectly connected to the crank member 132 via a connection of the handle 342 to the crank member 132. In some configurations, at least one of the attachment portions 406, 408 may include a link to a gear system that rotates the threaded rod 344 when the handle 342 is rotated. Such configurations may be beneficial when the handle 342 is not directly connected to the threaded rod 344.

In some arrangements, a plurality of aligned threaded rods may be provided to fit within the crank member 132. The plurality of threaded rods may have their axial rotations synchronized by a gear system such as, for example, a worm gear linking the threaded rods. The stem assembly 362 may then be threaded to each of the plurality of threaded rods, improving its stability and reducing the amount pressure caused by contact between the stem assembly 362 and individual threads on a single threaded rod 344. This system may also reduce pressure between the stem assembly 362 and the internal surfaces of the crank member 132 which prevent the stem assembly 362 from rotating along with the threaded rod 344 when it is rotated by the handle 342.

The stem assembly 362 may be in threaded connection with the threaded portion 404 of the threaded rod 344. The stem assembly 362 may comprise a threaded rod guide 410 connected to a pivot stem 412. The threaded rod guide 410 may be the portion of the stem assembly 362 that contacts the threaded rod 344 and the interior areas of the crank member 132. The threaded rod guide 410 may therefore have a threaded aperture 414 sized and positioned to receive the threaded rod 344 when assembled within the outer end 340 of the crank member 132. The pivot stem 412 may provide a smooth surface on which the pivot connection 138 may slidably and pivotally be connected. In some embodiments, the stem assembly may include a stem guard 416 positioned between the threaded rod guide 410 and pivot stem 412. The stem guard 416 may provide smooth rotation of the pivot connection 138 when attached to the pivot stem 412 by preventing wobbling of the pivot connection 138 or reducing friction on the slot 360 or housing of the outer end 340 adjacent to the slot 360. A stem guard 416 may comprise a durable material such as brass, urethane, or another material suitable for low-friction protection of the crank member 132. The stem guard 416 may include a bushing.

The pivot connection 138 may include a pivot cylinder 418. The pivot cylinder 418 may house a bearing (not shown) to reduce friction between the pivot cylinder 418 and the pivot stem 412. In some embodiments, no bearing is used. The pivot cylinder 418 may be attached to an end of the reciprocating foot support 134 such that when the pivot connection 138 moves, the reciprocating foot support 134 is linked in motion. For example, the reciprocating foot support 134 may be welded to the pivot cylinder 418. An opening 420 in the pivot cylinder 418 may receive the pivot stem 412. The opening 420 may be an aperture through the entire width of the pivot cylinder 418 or may extend partially through the cylinder 418 from the side of insertion of the pivot stem 412. The external area of the pivot cylinder 418 may be covered by a cap 422. The cap 422 may attach to the outer end of the pivot stem 412 using a fastener. The cap 422 may prevent inadvertent disassembly of the pivot connection 138 from the stem assembly 362. In some embodiments, the construction of the end of the pivot stem 412 secures the pivot connection 138 to the stem assembly 362. For example, a knob may be formed at the end of the pivot stem 412 that locks into a portion of the pivot cylinder 418. In some embodiments, the cap 422 may be used as a shield to keep debris from entering the opening 420 and disrupting the smooth motion of the bearing or otherwise disrupt the motion of the pivot stem 412 within the pivot cylinder 418.

In another embodiment, the position of the pivot cylinder 418 and pivot stem 412 may be reversed. For example, the pivot connection 138 may include a pivot stem 412 which extends inward to a pivot cylinder 418 that is attached to the threaded rod guide 410 and is part of the stem assembly 362. This alternative arrangement may eliminate the cap 422.

Figure 5:
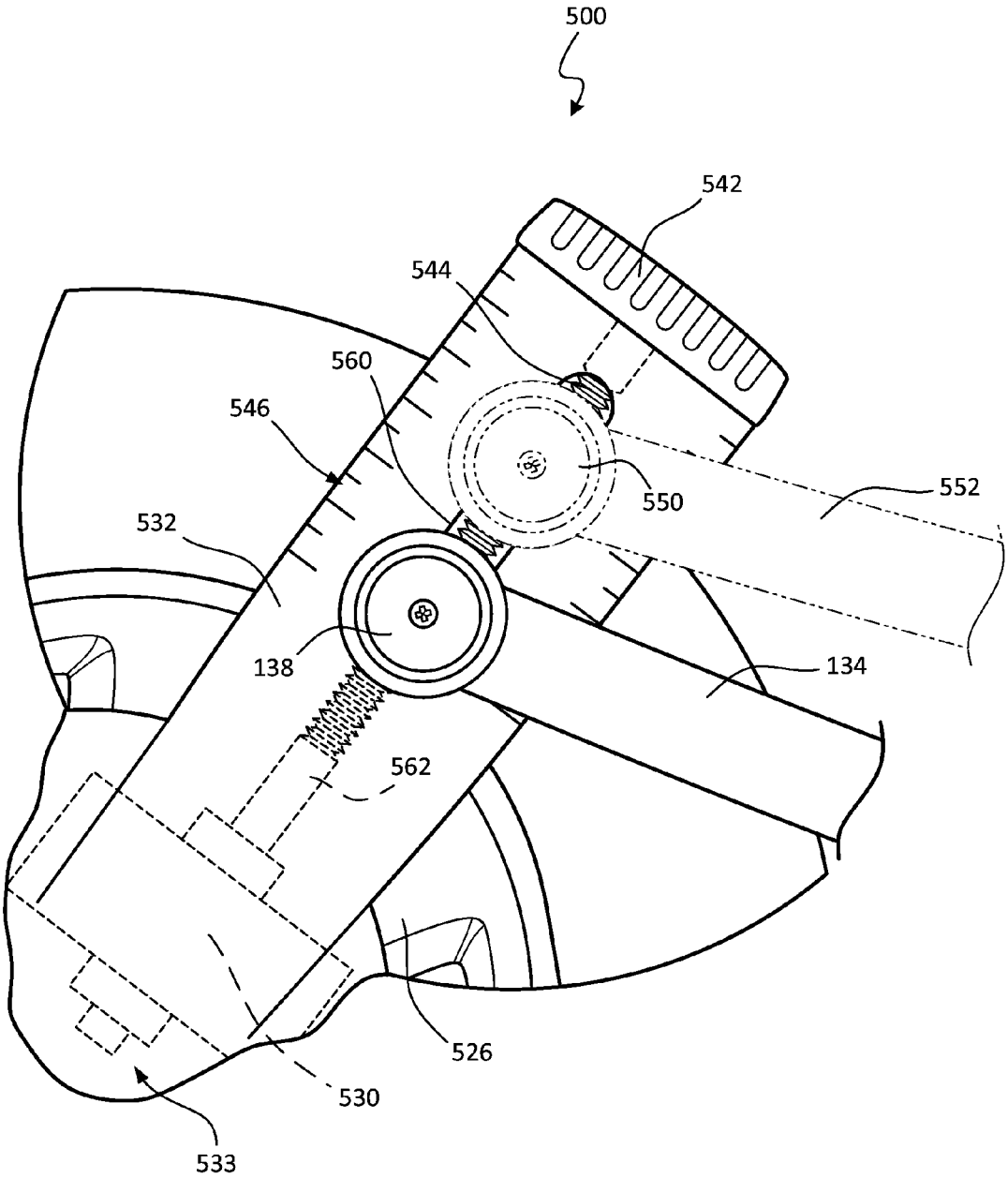
FIG. 5 shows an alternative example of a drive unit for an elliptical exercise machine having adjustable stride radius according to an embodiment of the present disclosure.

FIG. 5 shows an alternative embodiment of a drive unit 500 for an elliptical exercise machine linked to a reciprocating foot support 134 by a pivot connection 138. The drive unit 500 may include a rotation base 526 from which an integrated crank member 532 radially extends from a center of rotation 533. The crank member 532 houses a threaded rod 544 connected to the pivot connection 138. The end of the crank member 532 may include a handle 542.

A motor 530 may be housed within the drive unit 500. For example, the motor 530 may be housed within the rotation base 526 proximate to the center of rotation 533. The motor 530 may be linked to the threaded rod 544. For example, the motor 530 may be attached to the internal end 562 of the threaded rod 544 or may be connected indirectly to the threaded rod 544, such as, for example, by a gear system or drive train. The motor 530 may rotate with the rotation base 526 as the crank member 532 rotates, or the motor 530 may be stationary within the drive unit 500. The motor 530 may be powered by an electrical source of energy linked with the elliptical exercise machine. For example, the motor 530 may be powered by a battery system, a connection to an electrical power grid, or other generator of electrical energy connected with the elliptical exercise machine.

The motor 530 may also be connected to a controller. The controller may provide commands for the motor 530 to turn the threaded rod 544. In some embodiments, the controller may be near to or on the exterior of the housing of the rotation base 526. In some embodiments it may be beneficial for the controller to be positioned on the console or handles of the elliptical exercise machine (e.g., the console 118 or handles 120, 122, 156, 158). With controls on the handles or console, the user may have convenient access to stride radius adjustment while operating the machine.

The motor 530 may provide a torque to the internal end 562 of the threaded rod 544, thereby causing rotation of the threaded rod 544 about its longitudinal axis running along the crank member 532. Using the motor 530, the radius between the center of rotation 533 and the point of connection of the pivot connection 138 to the crank member 532 may be changed with little effort from the user. The motor 530 may rotate the threaded rod 544, which then translates the pivot connection 138 through a threaded connection to the threaded rod 544. In this embodiment, the handle 542 may also rotate due to a fixed connection to the threaded rod 244. This property may be beneficial in that it may allow the user to choose between rotating the handle 542 or operating the motor 530 to adjust the position of the pivot connection 138. In some arrangements, the motor 530 may be positioned to apply a torque at an outside end of the threaded rod 544.

In embodiments where the threaded rod 544 is connected to the motor 530, the threaded rod 544 may beneficially have a length within the crank member 532 sufficient to reach the motor 530 proximate to the center of rotation 533. The threaded portion of the threaded rod 544 (e.g., the threaded portion 404 of FIG. 4) may have a length effective to permit the pivot connection 138 to traverse the threaded portion along the length of a slot 560 in the crank member 532. In some examples, the internal portion 562 of the threaded rod 544 not exposed to the slot 560 is not threaded. Additionally, the crank member 532 may include a mechanism for preventing the pivot connection 138 from translating too far toward the center of rotation 533. For example, the mechanism for preventing translation may be a flange around the threaded rod preventing translation of the pivot connection 138 when the stem assembly comes into contact with the flange. In another example, the controls for the motor 530 may prevent the motor from driving the threaded rod 544 past a predetermined rotation limit beyond which limit the stem assembly would move the pivot connection 138 too close to the center of rotation 533 or into undesirable contact with the slot 560. In yet another example, the slot 560 may be formed in a material sufficiently rigid to prevent movement of the stem assembly beyond the limits defined by the slot opening.

Movement of the pivot connection 138 and reciprocating foot support 552 is illustrated using the dashed-line pivot connection 550 and reciprocating foot support 552, where the pivot connection 138 has translated along the threaded rod 544 to the position of pivot connection 550. In this example, the stride radius of the elliptical exercise machine has increased. The reciprocating foot supports 134, 552 are also shown at different angles relative to the threaded rod 544, thereby illustrating the pivoting capabilities of their respective pivot connections 138, 550.

In other embodiments, a fixed end cap may take the place of the handle 542, and the fixed end cap may not rotate along with the threaded rod 544. In some of these embodiments, the fixed end cap may be integrated with the crank member 532. This arrangement may be preferable if the shape of the handle interferes with travel of the reciprocating foot support 134 and pivot connection 138 as they revolve around the rotation base 526 during operation of the elliptical exercise machine.

The motor 530 may provide torque to one threaded rod 544. Multiple motors may be implemented in the elliptical exercise machine to provide torque to each threaded rod (e.g., threaded rods 244, 344). In other embodiments the threaded rods connected to each reciprocating foot support 134, 136 may all be acted upon by output of one motor 530 via a gearing system or other drive train linking the rotation of each threaded rod. With this configuration, it may be beneficial to ensure that each threaded rod rotates at about the same rate so that the stride radius of each pivot connection is about equal, as measured along the threaded rods, or as measured using the stride indicators 546 on a crank member 532.

Although the present disclosure has primarily made reference to rear-mounted elliptical exercise machines, other types of elliptical exercise machines may adopt the mechanisms, systems, and methods described herein by adaptation, including front-mounted or mid-mounted elliptical exercise machines. Further, while the examples above have been described with reference to the adjustable connection comprising a threaded rod to move the connection point along the length of the crank member, any suitable translation mechanism may be used in accordance with the principles described in the present disclosure. For example, such a translation mechanism may include a hydraulic mechanism, a pneumatic mechanism, a magnetic mechanism, another type of mechanism, or combinations thereof.

INDUSTRIAL APPLICABILITY

In general, the invention disclosed herein may provide a user with an elliptical that has an adjustable stride. Such stride adjustment may be accomplished without disassembling parts of the foot support and/or footholds. The adjustable drive unit assemblies described above may allow a variable radius of rotation of a pivot connection of a reciprocating foot support as it moves around a center of rotation of a drive unit. This may provide adjustability of the stride rotation radius to an infinite level of precision. Some embodiments of the present disclosure may be self-contained, involve low maintenance, and no removable parts that are prone to being lost or stolen.

In some embodiments, the adjustability of the radius of rotation around the drive unit of the reciprocating foot supports may be provided by a threaded rod running at least partially radially outward from the center of rotation of the drive unit, and the connection between the drive unit and the reciprocating foot supports may be adjusted by turning the threaded rod and driving a connection to the threaded rod inward or outward relative to the center of rotation, as desired. The elliptical exercise machine may be adjusted using a motor, a handle or lever for rotating the threaded rod, another mechanism, or a combination of these elements. The rotation of the threaded rod moves a pivot connection to the reciprocating foot supports along its longitudinal axis due to a threaded connection between the rod and the pivot connection or the rod and a linkage to the pivot connection.

An adjustable stride radius may provide improved comfort to certain users, since the length of the users' natural stride may be matched to the preset stride of the elliptical machine. In some arrangements, the system for adjustment may also provide improved ability to isolate and exercise particular muscle groups that may be the focus of certain larger or smaller strides. Some of the disclosed systems support consistent repetitive motion instead of allowing the user to continuously vary their stride motion yet also allow the user to make adjustments when desired. Some embodiments of the elliptical exercise machine adjustment system may reduce the conventional number of swinging linkages or other parts that may cause the machine to need a large area for clearance. In embodiments with a silent magnetic resistance (SMR) element, the machine may provide quiet operation with resistance at low cost.

The present disclosure is provided to enable a person skilled in the art to make or use the disclosure. Various modifications to the disclosure will be readily apparent to those skilled in the art, and the generic principles defined herein may be applied to other variations without departing from the spirit or scope of the disclosure. The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate.

Throughout this disclosure the term "example" or "exemplary" indicates an example or instance and does not imply or require any preference for the noted example. Thus, the disclosure is not to be limited to the examples and designs described herein but is to be accorded the widest scope consistent with the principles and novel features disclosed herein.

What is claimed is:

1. An elliptical exercise machine, comprising:

a crank member with a first portion connected to a resistance mechanism and a second portion comprising an adjustable connection arranged to attach to a foot support; a handle operatively connected to the crank member;

the adjustable connection being arranged to change a connection point between the crank member and the foot support along a length of the crank member;

a slot formed in the crank member between an end of the crank member and the center of rotation, wherein the foot support is connected to the adjustable connection through the slot;

wherein the slot includes a first closed end and a second closed end that define a translation range of the adjustable connection wherein movement of the handle changes the connection point between the crank member and the foot support; and wherein changing the connection point changes a stride length of the elliptical exercise machine.

2. The elliptical exercise machine of claim 1, wherein changing the connection point changes a stride length of the elliptical exercise machine.

3. The elliptical exercise machine of claim 1, wherein the adjustable connection comprises a threaded rod aligned with the length of the crank member and the foot support is shaped to connect to the threaded rod.

4. The elliptical exercise machine of claim 3, wherein the handle is connected to the threaded rod, wherein movement of the handle rotates the threaded rod.

5. The elliptical exercise machine of claim 4, wherein the handle is positioned proximate a distal end of the crank member.

6. The elliptical exercise machine of claim 3, further comprising a motor positioned to rotate the threaded rod.

7. The elliptical exercise machine of claim 1, wherein the resistance mechanism comprises a flywheel.

8. The elliptical exercise machine of claim 1, further comprising stride indicators positioned proximate the slot.

9. The elliptical exercise machine of claim 1, wherein the adjustable connection is a pivot connection.

10. The elliptical exercise machine of claim 1, wherein the adjustable connection comprises a pivot stem arranged transverse the threaded rod.

11. An elliptical exercise machine, comprising:

a crank member with a first portion connected to a resistance mechanism and a second portion comprising an adjustable connection arranged to attach to a foot support;

the adjustable connection being arranged to change a connection point between the crank member and the foot support along a length of the crank member; and the adjustable connection comprises a threaded rod aligned with the length of the crank member and the foot support is shaped to connect to the threaded rod; a handle operatively connected to the crank member; a slot formed in the crank member between an end of the crank member and the center of rotation, wherein the foot support is connected to the adjustable connection through the slot;

wherein the slot includes a first closed end and a second closed end that define a translation range of the adjustable connection; wherein movement of the handle changes the connection point between the crank member and the foot support;

wherein changing the connection point changes a stride length of the elliptical exercise machine.

12. The elliptical exercise machine of claim 11, further comprising stride indicators positioned proximate the slot.

13. The elliptical exercise machine of claim 11, wherein the adjustable connection is a pivot connection.

14. The elliptical exercise machine of claim 11, wherein the adjustable connection comprises a pivot stem arranged transverse the threaded rod.

15. The elliptical exercise machine of claim 11, further comprising a motor positioned to rotate the threaded rod.

16. An elliptical exercise machine, comprising:

a crank member with a first portion connected to a resistance mechanism and a second portion comprising an adjustable connection arranged to attach to a foot support;

the adjustable connection being arranged to change a connection point between the crank member and the foot support along a length of the crank member;

the adjustable connection comprises a threaded rod aligned with the length of the crank member and the foot support is shaped to connect to the threaded rod; a handle operatively connected to the crank member;

a slot formed in the crank member between an end of the crank member and the center of rotation, and the foot support is connected to the adjustable connection through the slot;

the slot comprises a first closed end and a second closed end that define a translation range of the adjustable connection; and the adjustable connection is a pivot connection with a pivot stem arranged transverse the threaded rod; wherein movement of the handle changes the connection point between the crank member and the foot support;

wherein changing the connection point changes a stride length of the elliptical exercise machine.

* * * * *